United States Patent [19]

Simpson et al.

[11] 4,437,668

[45] Mar. 20, 1984

[54] PUZZLE POST TOY

[75] Inventors: Danny E. Simpson, Baltimore, Md.; David M. Williams, New York, N.Y.; Richard A. Chase, Baltimore; Lawrence B. Grubb, Monkton, both of Md.

[73] Assignee: Johnson & Johnson Baby Products Company, New Brunswick, N.J.

[21] Appl. No.: 385,146

[22] Filed: Jun. 4, 1982

[51] Int. Cl.[3] ..... A63F 9/12

[52] U.S. Cl. ..... 273/156; 46/17; 206/499; 434/259

[58] Field of Search ..... 273/156, 153 P; 434/259; 206/499, 500, 505, 514; 46/17

[56] References Cited

U.S. PATENT DOCUMENTS

| | | | |
|---|---|---|---|
| 2,124,352 | 7/1938 | Patten | 206/514 X |
| 2,399,566 | 4/1946 | Owen | 46/17 X |
| 3,841,053 | 10/1974 | Weatherhead et al. | 206/499 X |
| 3,877,697 | 4/1975 | Lersch | 273/26 R |
| 3,984,110 | 10/1976 | Eckert | 206/499 X |
| 4,239,230 | 12/1980 | Shoptaugh | 273/271 X |

*Primary Examiner*—Anton O. Oechsle
*Attorney, Agent, or Firm*—Jason Lipow

[57] ABSTRACT

A puzzle toy is provided comprising a plurality of pieces which can be easily gripped and manipulated by a young child and which can be assembled and disassembled into various structural combinations. The puzzle comprises pieces of various sizes having an aperture therein for fitting around a post upstanding from the base. The pieces are so designed so as to allow them to be placed randomly on the post and by manipulating and jogging the pieces, the puzzle solver may order the pieces in size order about the post.

16 Claims, 6 Drawing Figures

PUZZLE POST TOY

BACKGROUND OF THE INVENTION

This invention relates to a puzzle toy for small children and in particular for children ranging in age of from 18 months to four years. Specifically, this invention is concerned with producing a puzzle toy for children of this age range which puzzle is solved by placing a series of pieces, having gradually increasingly larger planar dimensions, about a post held in place on a base.

In providing a puzzle toy for children of the subject age range, several criteria must be met. Firstly, the toy must be sufficiently varied in size, shape, and color so as to attract the child's attention at the outset. For example, children are apt to be attracted to such toys having multiple parts which can be manipulated separately or together.

Secondly, the various parts of the toy must be easily gripped by the relatively inexperienced child so that the child can separate the toy into its component parts and experiment with various reconstructions.

Perhaps most importantly, in the case of puzzles, the toy should be designed in such a manner as to provide the child with a high likelihood of success in solving the puzzle or, at least, a high likelihood of solving the puzzle in part. Concommitment with the characteristic of a relatively easy solution, ideally, the toy should present an additional, more subtle challenge to the child whereby the child's interest is encouraged and maintained.

SUMMARY OF THE INVENTION

In accordance with this invention, a puzzle toy is provided comprising a plurality of pieces which can easily be gripped and manipulated by a young child and which can be assembled and disassembled into various structural combinations. The puzzle solving aspect of the toy of this invention involves placing each of the various pieces in size order around a post upstanding from a base and is designed so as to provide the child with a high degree of success in ordering certain of the pieces while presenting a challenge to the more sophisticated puzzle solver with respect to other pieces.

The puzzle toy comprises therefore a generally planar base having means for afixing thereto, preferably centrally, an upstanding post. A series of pieces of varying shapes are provided, each having a bottom for resting on the base, an axial direction, and projects a geometric figure onto a plane perpendicular to the axial direction. The longest straight-line distance between any two points on the periphery of such geometric figure is herein defined as the "long dimension" of the piece. Each of the pieces has a different long dimension. Each piece is provided with an aperture large enough to accommodate each of the other pieces having a smaller long dimension and none of the other pieces having a larger long dimension. By "accommodate" it is meant to allow each of the smaller pieces to fit within the aperture and rest on the base.

Each of the pieces may be placed around the post, with the post passing through the aperture of the piece. By applying the above set out criteria, it has been discovered that irrespective of the order in which each of the pieces is so placed, by sufficient manipulation such as turning, shaking or jogging and without the need for removing them from the post, the pieces will ultimately settle into a stabilized configuration in which they are ordered about the post, in long dimension size order, with the largest long dimension piece being most remote from the post and the smallest long dimension piece being the most proximate to the post. In such stable position the pieces rest with their respective bottoms on said base.

It has also been discovered that a piece having a uniform circular cross-section transverse to the axis is most easily manipulated into the above described order. Accordingly, it is preferable that a substantial number of pieces provided for this toy be of uniform circular cross-section. Most preferably, with respect to their size order, it is desirable that every other piece be provided with such a uniform circular cross-section. In this manner a small child attempting to manipulate the toy into its stable configuration will meet with relatively easy success for a substantial number of pieces. On the other hand, the remaining pieces may have various uniform or nonuniform cross-sections in such shapes as triangles, squares, or even irregular shapes.

To aid the child in discriminating the various shapes from each other it is desirable that all similarly shaped pieces have the same color. Accordingly, for example, all circles may be red all triangles green, and all squares yellow.

In a preferred embodiment, means are provided for ensuring that the young child can easily grip each of the pieces to facilitate assembly and disassembly. Such means comprise providing that each successively smaller piece i.e., each piece with a successively smaller long dimension, be taller in its axial direction than the next larger piece i.e., the piece with the next larger long dimension. In this manner, when the pieces are in their stable configuration about the post in size order, each successively smaller piece will have a portion projecting above the next larger piece which may be gripped by the child for removing such piece.

It is preferred that every effort be made to facilitate the manipulation of the pieces by a small child. To this end for example the pieces must be high enough to grip. Said in other words, when affixed to the post in a stable position the pieces must exhibit a height sufficient for a child to hold onto without undue difficulty. For example, it is preferred that the pieces have a height of at least about $\frac{1}{2}$ inch with a minimum height of $\frac{3}{4}$ of an inch being preferred. Further, the pieces should exhibit a portion for gripping when in the stable position which is spaced away from succeeding pieces so that a child can reach in and remove any given piece. Preferably the spacing is at least $\frac{1}{4}$ inch.

In still another embodiment, the post is removably affixed to the base by being force fitted onto or into a relatively short projection integral with the base. The young child has difficulty in distinguishing top from bottom and upright from upside down. Accordingly, the post and projection are so provided as to allow them to be fitted together irrespective of the orientation of either piece. This is accomplished by having the projection comprise a hollow cylinder extending upward from a major surface of said base and being open and accessable for post emplacing from the opposite major surface of said base. The external wall of said projection is provided with peripheral shoulders of decreasing diameter and the internal surface is also provided with corresponding decreasing diameter peripheral shoulders. The post comprises a hollow somewhat tapered cylinder and having therefore, at one end, a large inside and outside diameter and, at the other end, a small inside and outside diameter. The post and the outer surface of the projection are so sized as to allow the post to be force fitted about the projection with the large inside diameter end of the post being forced fitted about the projection and supported by one of the outer shoulders of the projection. Alternately, the post may be force fitted about the projection with the small inside diameter end being force fitted about the projection and supported by a second outer shoulder of the projection. Similarly, the post and projections are so sized as to allow the large outside diameter of the post to be force fitted within the projection and supported by one of the inner shoulders of the projection. Alternately, the small outer diameter of the post may be force fitted within the projection and supported by a second inner shoulder of the projection.

BRIEF DESCRIPTION OF THE DRAWINGS

The invention will be better understood by the following description taken in combination with the appended drawings in which.

DETAILED DESCRIPTION OF THE INVENTION

Figure 1:
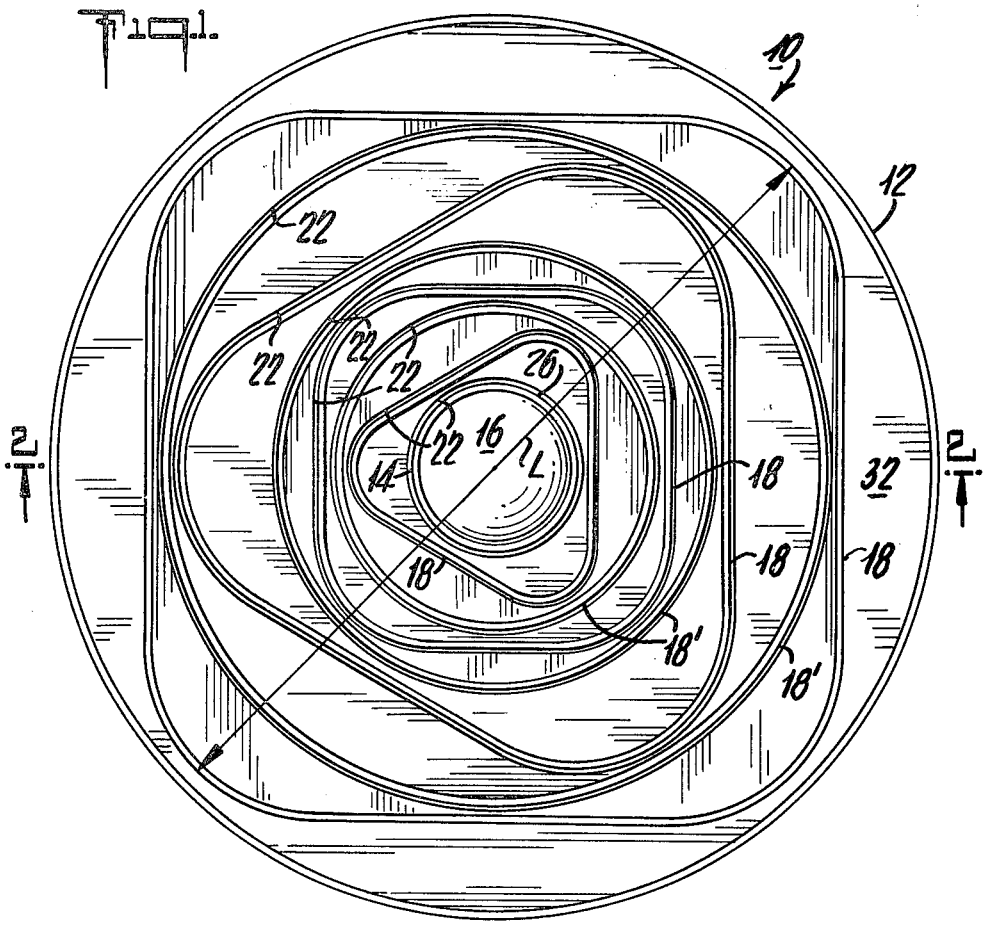
FIG. 1 is a planar view of an assembled embodiment of the puzzle toy of this invention.
Figure 2:
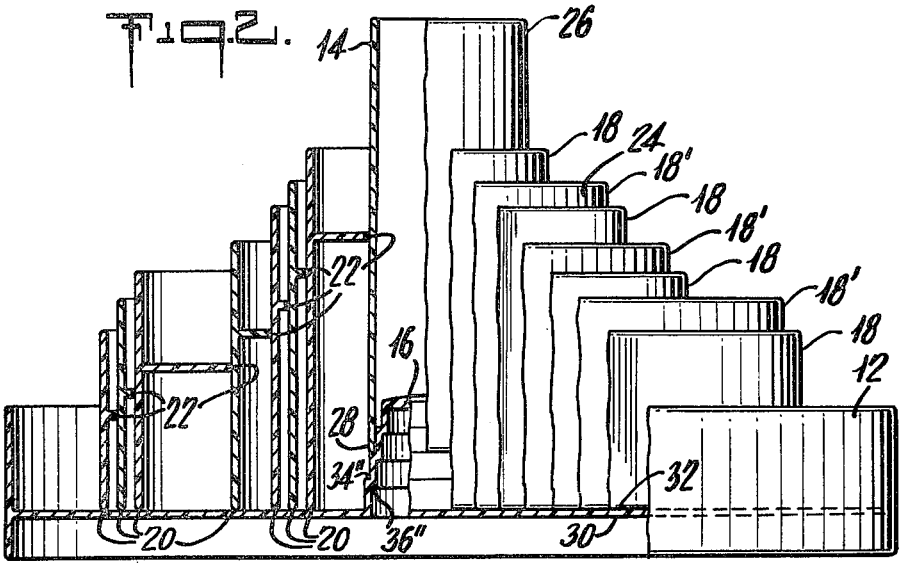
FIG. 2 is an elevational view of the puzzle toy of FIG. 1, shown in partial cross-section, taken through line 2—2.
Figure 3:
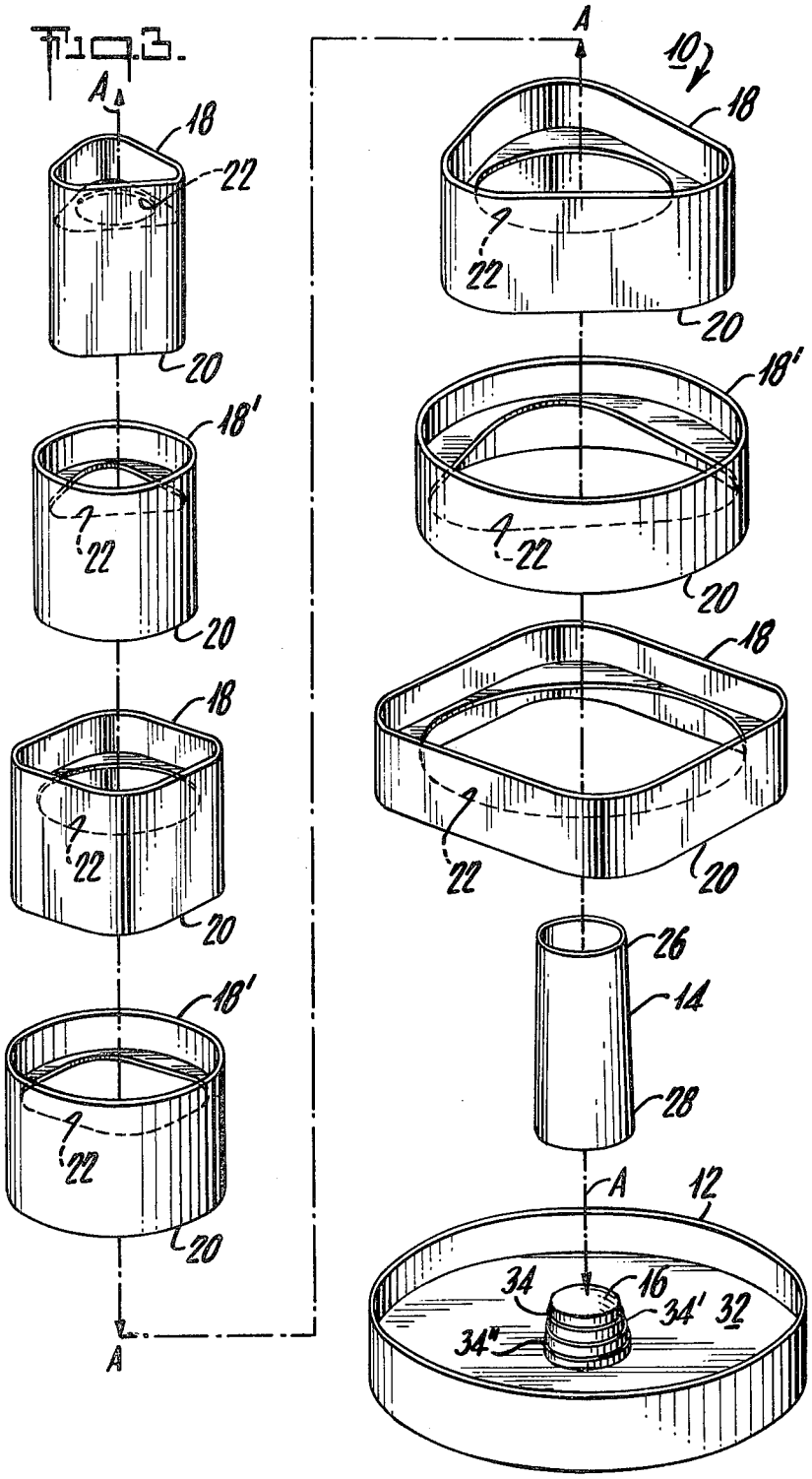
FIG. 3 is an exploded, perspective view of the puzzle toy of FIG. 1.

Referring now to FIGS. 1–3, inclusive, of the drawings, illustrated therein in planar, elevational and exploded perspective views, respectively, is an embodiment of the puzzle toy 10 of this invention.

As illustrated, the puzzle toy 10 comprises a base 12, a post 14 centrally affixed to a projection 16 upstanding from said base, and a plurality of various shaped pieces 18 and 18'. Each of the pieces 18 and 18' have a bottom 20 for resting on base 12, and an axial direction indicated by the line A—A.

Further, each piece, when projected onto a plane perpendicular to the axial direction of the piece such as, for example, in FIG. 1, describes a closed geometric figure. The largest straight-line distance between any two points on the periphery of each geometric figure is defined herein as the "long dimension" of the piece. This long dimension is exemplified in FIG. 1 by the dimension line L, with respect to the square shaped, outermost piece 18. As is apparent from the drawings each of the pieces 18 have varying long dimensions. As best illustrated in FIG. 3, each piece is provided with an aperture 22 which aperture is so sized as to accommodate each of the other pieces having a smaller long dimension and none of the other pieces having a larger long dimension. The latter relationship is most apparent from an inspection of FIG. 2, the assembled cross-sectional elevational view of the puzzle toy.

It has been discovered that by adhering to the teachings of this invention, when the post is fitted onto the base and the pieces are placed around the post, irrespective of the order in which each of the pieces is so placed around the post, by sufficient turning, shaking or jogging and without removing the pieces from the post, the pieces will ultimately settle into a stabilized configuration in which they are ordered about the post, in long dimension size order, with the largest long dimension piece being most remote from the post and the smallest long dimension piece being the most proximate to the post. Such a stable configuration is illustrated in FIGS. 1 and 2. Thus, for example, referring to the exploded perspective view of FIG. 3, the pieces are illustrated in exact size order. Nevertheless, in accordance with the teachings of this invention, this order may be varied in a completely random manner when emplacing the pieces about the post base assembly. The pieces will remain in such random order until, after manipulation such as turning, etc., they assume the stable configuration illustrated in FIGS. 1 and 2.

It has also been discovered that the degree of manipulation required for placing the puzzle into the stable configuration is, to an extent, a function of the general shape of the pieces i.e. the shape of the geometric figure projected onto a plane perpendicular to its axial direction. Specifically, circular shaped pieces are most easily manipulated into size order. To insure that a young child will meet with some degree of success, a substantial number of pieces are provided having such a circular projection and, preferably, noncircular pieces 18 are alternated, in long dimension size order, with circular pieces 18'.

Because the puzzle toy of this invention is to be used by young children, means are provided to ensure that the young child can grip each piece for easy assembly and disassembly. Such means comprise providing that a portion of each piece, when resting on the base in the stable position, extends above all other pieces having a larger long dimension. Accordingly, a gripping surface is available for manipulating the piece. As is illustrated in FIG. 2 portion 24 of the piece 18' extends above the next largest piece 18 and hence may be gripped by the puzzle solver.

In the embodiment of the invention illustrated in FIG. 1–3, the post 14 is a hollow cylinder and is affixed to the base 12 by being force fitted over the upstanding projections 16 integral with the base. It will be appreciated that a young child may find it difficult to affix the post to the projection in that such child will have difficulty in ascertaining which major surface of the base should face upward and which end of the post should be applied to the projection. Accordingly, both the post 14 and the projection 16 have been designed so that, irrespective of which way they are oriented, the post can be easily affixed to the base.

In this connection, the post is a hollow cylinder, preferably open at both ends, and having a slight taper so that a narrow end 26 has a relatively small inside and outside diameter and a wide end 28 has a relatively large inside and outside diameter. The base projection 16 is also a hollow cylinder which is open to a major surface 30 of the base and projects upward from the opposite major surface 32. The external wall of the projection 16 is provided with peripheral shoulders of varying diameter 34, 34' and 34''. The internal surface of the projection 16 is also provided with corresponding peripheral shoulders of varying diameter 36, 36', and 36''.

Figure 4:
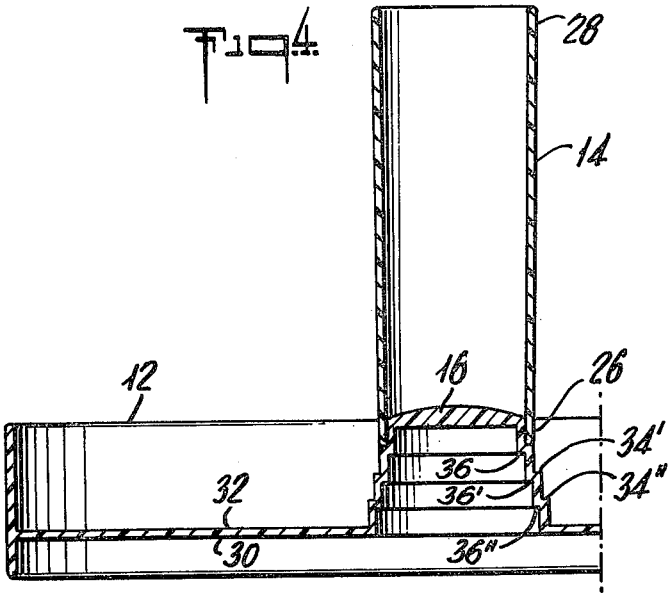
FIG. 4 is a cross-sectional, fragmentary view of the post and base of the puzzle toy of FIG. 1, assembled in a first alternative mode.
Figure 5:
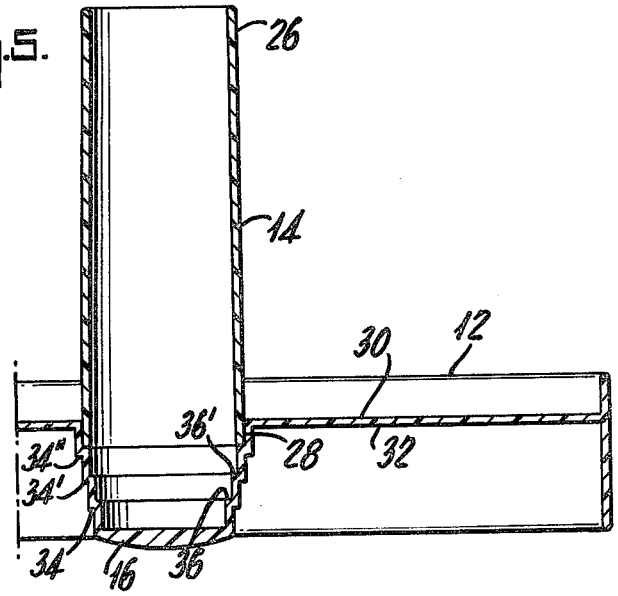
FIG. 5 is a cross-sectional, fragmentary view of the post and base of the puzzle toy of FIG. 1 in a second alternative mode.

The post and the projections are so sized that when, for example, the base is placed in an orientation with the projection 10 extending upwardly and the post is fitted onto the projection at its large end 28 (as is illustrated in FIG. 2) the post may be force-fitted around the projection and rest on one of the projection's outer shoulders 34'. If instead, the child attempts to fit the small end 26 of the post onto the projection, the post again will be force-fitted around the projection and rest on another of the outer shoulders 34, as is illustrated in FIG. 4. Should the child orient the base with the open side of the projection facing upwardly and attempt to affix the large end 28 of the post to the projection, the post will be force-fitted into the projection and rest on one of the inner shoulders 36'', as illustrated in FIG. 5. Again, should the child attempt to affix the small end 26 of the post within the projection, the post will be force fitted within the projection and rest upon another inner shoulder 36', as is illustrated in FIG. 6.

Figure 6:
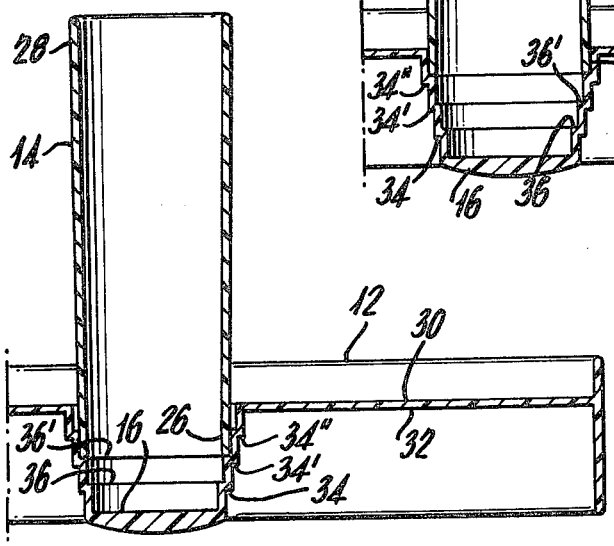
FIG. 6 is a cross-sectional, fragmentary view of the post and base of the puzzle toy of FIG. 1 in a third alternative mode.

Referring to FIGS. 5 and 6, the projection 16 preferably is provided with a closed, domed end which projects beyond the base of the toy. In this manner, when the toy is placed in the position shown in FIGS. 5 and 6 the base is spinning about the domed end of the projection.

The puzzle toy of this invention may be constructed from any suitable material, many of which being well known to those skilled in the art. Needless to say, such materials should be chosen with the safety of small children foremost in mind and accordingly should be nontoxic, nonsplintering, and without sharp edges. Similarly, the toy may be decorated using various colorants again chosen with safety in mind. Materials such as metal, wood or cardboard may be employed but generally the materials of choice are thermoplastic polymer materials such as polypropylene, polystyrene, or the like.

What is claimed is:

1. A puzzle toy comprising:

a generally planar base;

a post upstanding from said base;

a plurality of pieces, each having a planar aperture for fitting around said post and a bottom for resting on said base;

said pieces each having an axial direction perpendicular to said planar aperture and each piece projecting onto a plane perpendicular to said axial direction a closed geometric figure, said geometric figure having a long dimension;

each of said pieces projecting said geometric figure having a different long dimension;

at least one of said geometric figures being circular and at least one of said geometric figures being non-circular;

said aperture of each piece being large enough to accommodate each of the other pieces having a smaller long dimension and not large enough to accommodate any other piece having a larger long dimension;

whereby said pieces may be stacked onto said post in any order and, by sufficient manipulating without removal from said post, can be made to assume a stable configuration in size order about said post.

2. The puzzle toy of claim 1 wherein more than one of said geometric figures are non-circular.

3. The puzzle toy of claim 1 wherein more than one of said geometric figures are circular.

4. The puzzle toy of claim 1 wherein more than one of said geometric figures are non-circular and wherein more than one of said geometric figures are circular.

5. The puzzle toy of claim 4 wherein said pieces, arranged in long dimension size order, alternately have circular and non-circular geometric figures.

6. The puzzle toy of claim 1 comprising a piece having a generally square geometric figure.

7. The puzzle toy of claim 1 comprising a piece having a generally triangular geometric figure.

8. The puzzle toy of claim 1 wherein means are provided for gripping each piece, said means comprising having each piece sized taller in its axial direction than the next piece having the next largest long dimension whereby a portion of said each piece projects above said next piece when said pieces are in a stable configuration.

9. The puzzle toy of claim 1 wherein means are provided for removably affixing said posts to said base.

10. The puzzle toy of claim 9 wherein said means comprise a projection integral with the base to which said post is force fitted.

11. The puzzle toy of claim 10 wherein said post comprises a tapered hollow cylinder having a relatively large end and a relatively small end and said projection comprises a cylinder, extending upward from a major surface of said base and having an open end accessible for post emplacing from the opposite major surface of said base.

12. The puzzle toy of claim 11 wherein said projection is provided on its outer walls with outer shoulders, an outer shoulder having a diameter sized so as to allow said large end of said post to be force fitted onto said projection and rest on said shoulder and a second outer shoulder having a diameter sized so as to allow said small end of said post to be force fitted onto said projection and rest on said second outer shoulder.

13. The puzzle toy of claim 11 wherein said projection is provided on its inner walls with inner shoulders, an inner shoulder having a diameter sized so as to allow said large end of said post to be force fitted within said projection and rest on said inner shoulder and a second inner shoulder having a diameter sized so as to allow said small end of said post to be force fitted within said projection and rest on said second inner shoulder.

14. A puzzle toy comprising:

a generally planar base;

a post upstanding from said base;

a plurality of pieces, each having a planar aperture for fitting around said post and a bottom for resting on said base;

said pieces each having an axial direction perpendicular to said planar aperture and each piece projecting onto a plane perpendicular to said axial direction a closed geometric figure, said geometric figure having a long dimension;

each of said pieces projecting said geometric figure having a different long dimension;

at least one of said geometric figures being circular and at least one of said geometric figures being non-circular;

said aperture of each piece being large enough to accommodate each of the other pieces having a smaller long dimension and not large enough to accommodate any other piece having a larger long dimension;

means provided for affixing said post to said base; said means comprising a projection integral with said base to which said post is force fitted; said post comprising a tapered hollow cylinder having a relatively large end and relatively small end and said projection comprising a cylinder extending upward from said major surface of said base and having an open end accessible for post emplacing from the opposite major surface of said base.

15. The puzzle toy of claim 14 wherein said projection is provided on its outer walls with outer shoulders, an outer shoulder having a diameter sized so as to allow said large end of said post to be force fitted onto said projection and rest on said shoulder and a second outer shoulder having a diameter sized so as to allow said small end of said post to be force fitted onto said projection and rest on said second outer shoulder.

16. The puzzle toy of claim 14 wherein said projection is provided on its inner walls with inner shoulders, an inner shoulder having a diameter sized so as to allow said large end of said post to be force fitted within said projection and rest on said inner shoulder and a second inner shoulder having a diameter sized so as to allow said small end of said post to be force fitted within said projection and rest on said second inner shoulder.

* * * * *